United States Patent [19]

Yamada

[11] 4,455,042

[45] Jun. 19, 1984

[54] LATCH DEVICE

[75] Inventor: Shinjiro Yamada, Tokyo, Japan

[73] Assignee: Mitsui Kinzoku Kogyo K.K., Tokyo, Japan

[21] Appl. No.: 383,100

[22] Filed: May 28, 1982

[51] Int. Cl.[3] ..... E05C 3/26

[52] U.S. Cl. ..... 292/201; 292/216

[58] Field of Search ..... 292/216, 280, 144, 201

[56] References Cited

U.S. PATENT DOCUMENTS 3,655,240 4/1972 DuRocher et al. ..... 292/201 X 4,093,289 6/1978 Inaboyashi et al. ..... 292/201 X

*Primary Examiner*—Richard E. Moore

*Attorney, Agent, or Firm*—Fitzpatrick, Cella, Harper & Scinto

[57] ABSTRACT

A latch device having a locking mechanism is locked and unlocked by a lock operating device comprising: a lock lever coupled to and operating the locking mechanism when driven to undergo displacement between terminal lock and unlock positions; a motor for driving the lock lever; a retaining member exerting an elastic force (1) to cause the lock lever to undergo the displacement with a click motion, over-riding an intermediate dead-center point against an elastic resistance and (2) to retain the lock lever positively in either terminal position after each displacement; and a retraction device for temporarily nullifying or greatly reducing the action of the retaining member at the time of the displacement of the lock lever.

7 Claims, 15 Drawing Figures

LATCH DEVICE

BACKGROUND OF THE INVENTION

This invention relates generally to latches and more particularly to latch devices for doors of vehicles such as motor vehicles or automobiles.

As is known, a door latch device of a vehicle such as a motor vehicle can be actuated in unlatching operation by manipulation of outside and inside door handles of the vehicle. In many cases a knob for locking is provided and is manipulated for placing the latch device of a closed and latched door in a state wherein the device cannot be unlatched by manipulation of either door handle. The same knob is manipulated in reverse movement to unlock the device. In other cases, depending on the type of vehicle, locking and unlocking of the latch devices of the vehicle is carried out by electromagnetic driving devices of an electrical control circuit which can be controlled by the manipulation of a button or knob by the vehicle driver.

In a latch device of known type having an electromagnetic driving device, a shifting member in the form of a lock lever for locking operation is provided in the interior of the body of the latch device and is driven by the electromagnetic driving device coupled thereto in rotation between the lock state and the unlock state. These lock and unlock states are two completely different states, and an intermediate state between these two extreme states cannot be permitted.

Accordingly, in a known latch device an elastic force is caused to be imparted to the lock lever, which has the function of establishing the lock state and the unlock state, on either side of a dead-center point as a dividing point. For this purpose, a so-called over-center spring is installed to cause the lock lever to undergo an angular displacement with a click motion from either one of two terminal positions respectively of the lock state and the unlock state to the other terminal position, and the lock lever cannot stall or linger at any position other than these two terminal positions.

The over-center spring exerts a relatively great spring force, which retains the lock lever in either one of its two terminal positions and assures that it will not shift randomly to any other position. However, this means that this considerably great force of the over-center spring must be overcome up to the dead-center position in shifting the lock lever from one terminal position to the other.

Accordingly, in the case of a latch device of the type wherein the above described displacement of the lock lever is remotely controlled by means of a driving means such as a motor or a solenoid, a motor or solenoid of large size and high output must be used as the driving means. This gives rise to a problem since, in the case of a door latch device of a motor vehicle or the like, it is desirable that the driving means be one of small size and low output as much as possible because it must be installed within the interior of the door.

SUMMARY OF THE INVENTION

It is an object of this invention to provide a latch device in which the above stated problem is overcome.

According to this invention, means are provided in a latch device of the above described character to temporarily nullify or reduce, at the time of operation of the driving means, the function of the spring for retaining the lock lever or a movable member coupled thereto in either of its lock and unlock positions thereby to reduce the resistance to be overcome by the driving means, which can then be of small size and low output.

According to this invention, briefly summarized, there is provided a latch device comprising a latch mechanism which can be actuated to hold a striker in latched state and to release the same in unlatched state; a locking mechanism which can be actuated between lock and unlock positions respectively to hold the latch mechanism in said latched state and to place the same in said unlatched state, said locking mechanism including a shifting member movable between a terminal lock position and a terminal unlock position thereby to actuate the locking mechanism between the lock and unlock positions thereof; a driving power source for driving the shifting member between said terminal positions; a retaining mechanism for exerting an elastic force such as to cause the shifting member to undergo displacement between said terminal positions with a click motion over an intermediate dead-center point by overcoming an elastic resistance due to said elastic force up to the dead-center point and to retain the shifting member positively in either of the terminal lock and unlock positions after each displacement; and retraction means for temporarily nullifying or greatly reducing said action of the retaining mechanism at the time of said displacement of the shifting member.

The nature, utility, and further features of this invention will be more clearly apparent from the following detailed description with respect to preferred embodiments of the invention when read in conjunction with the accompanying drawings briefly described below.

DETAILED DESCRIPTION OF THE INVENTION

Figure 1:
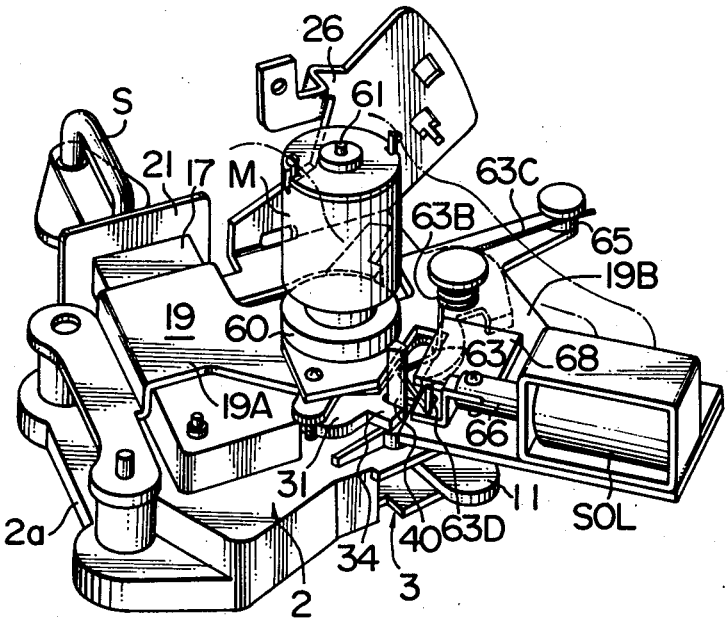
FIG. 1 is a perspective view of an example of a latch device according to this invention.

The latch device shown in FIG. 1 has a main support structure comprising a base member 2 (FIG. 4) made of a synthetic resin, for example, and a cover plate 3 (FIG. 3) fixedly attached to the back face of the base member 2. The base member 2 is formed to have a hollow interior for accommodating a latch mechanism described hereinafter. On its outer face, the base member 2 supports a mechanism for controlling the latch mechanism. The base member 2 is fixed by means such as rivets to the cover plate 3 on its back face to form an integral structure, which, in the case of a latch device for a side door of a motor vehicle (e.g., automobile), is mounted in a known manner to the door. The latch device is shown in FIG. 1 and related figures with an orientation which is convenient for the purpose of illustration and description. In the case of its installation in a motor vehicle door, the cover plate 3 is substantially vertical and flush with the distal or free vertical end face of the door, the end 2*a* of the base member 2 being on top.

Figure 3:
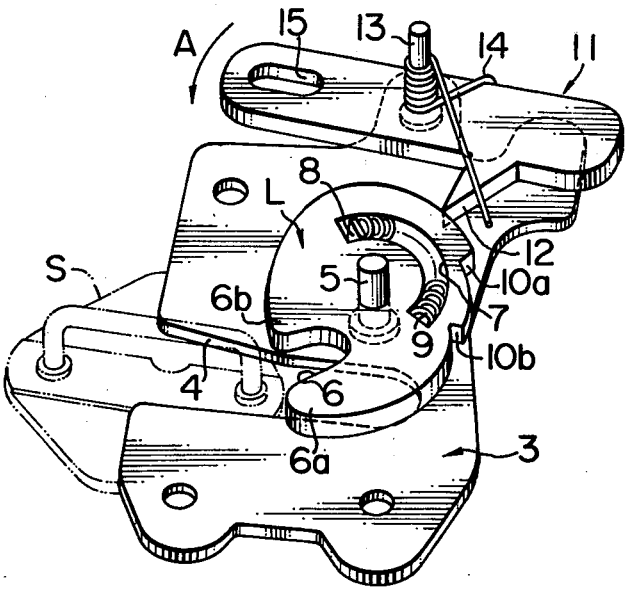
FIG. 3 is a perspective view of a cover plate and other parts disposed thereon of the same device.

As shown in FIG. 3, the cover plate 3 has a cut-out guide slot 4 into which a striker S fixed to the door jamb side of the car body enters in relative motion when the door is closed. A latch L is rotatably supported on a pivot pin 5 fixed at one end thereof to the cover plate 3 and straddles the inner closed-end part of this guide slot 4. As in the known art, the striker S lies in a substantially horizontal plane, and the latch L has a recess 6 for engagement with the striker S.

The latch L is further provided with an arcuate through slot 7 formed to lie in a circle with the pivot pin 5 as its center. A seat member 8 integrally fixed to the cover plate 3 is movably fitted in this slot 7. A compression spring 9 is inserted in compressed state in the slot 7 between one end thereof and the seat member 8, whereby the latch L is under a torque continually urging it to rotate clockwise as viewed in FIG. 3. At spaced-apart positions in its peripheral surface, the latch L has a notch tooth 10*a* for half-latch engagement and a notch tooth 10*b* for full-latch engagement.

These notch teeth 10*a* and 10*b* can be engaged and caught by a pawl 12 projecting from a ratchet lever 11, which is rotatably supported at its middle part by a pivot pin 13 fixed at its one end to the cover plate 3. A coil torsion spring 14 disposed around the pin 13 imparts to the ratchet lever 11 a torque continually urging it to rotate in the clockwise direction as viewed in FIG. 3 thereby to cause the pawl 12 to be continually pressed against the peripheral surface of the latch L. The ratchet lever 11 is provided near its end remote from the pawl 12 with a slot 15, whose function will be described hereinafter.

When the striker S enters the guide slot 4 in relative movement and engages with the recess 6 of the latch L, it pushes against a lobe 6*a* defining one side of the recess 6 and causes the latch L to rotate in the counterclockwise direction against the elastic force of the spring 9. As a consequence, the half-latch notch tooth 10*a* revolves to the position for engagement with the pawl 12. Simultaneously, a lobe 6*a* defining the opposite side of the recess 6 enters the loop of the striker S and engages with the striker in a half-latch state. Then, as the latch L is rotated further in the counterclockwise direction by the striker S, the notch tooth 10*a* disengages from the pawl 12 to revolve therepast, and, in its place, the full-latch notch tooth 10*b* engages with the pawl 12. Simultaneously, the lobe 6*b* engages more securely with the striker S. Thus, a full-engagement or full-latch state is attained.

This full-latch state can be terminated, that is, the latch mechanism can be unlatched, by rotating the ratchet lever 11 in the direction of the arrow A counter to the elastic force of the spring 14 thereby to disengage the pawl from the full-latch notch tooth 10*b* and thus to release the latch L.

Figure 4:
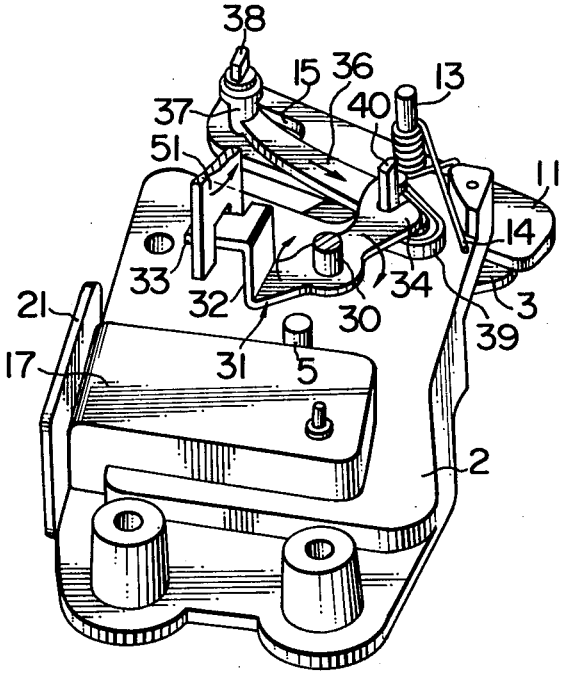
FIG. 4 is a perspective view of a base member and other parts disposed thereon of the same device.

The cover plate 3 supporting the latch L, the ratchet lever 11, and other parts of the latch mechanism as described above and illustrated in FIG. 3 is covered by the base member 2 in assembled state, in which the pivot pin 5 of the latch L projects out through the outer surface of the base member 2. The base member 2 has a hollow cover 17 covering the striker guide slot 4 as shown in FIG. 4. A flange 21 is attached to the open end of the cover 17 at the entrance of the striker guide slot 4.

On the outer surface (the upper surface as viewed in FIGS. 1 and 4) of the base member 2, there is mounted a frame structure 19, a part 19A of which rests on the outer surface of the hollow cover 17. This frame structure 19 has at one edge part thereof a vertical wall 26 substantially perpendicular to the remainder thereof. The frame structure 19 has a through hole (not shown) through which the aforementioned pivot pin 5 projects (upwardly as viewed in FIGS. 3 and 4). Furthermore, the frame structure 19 has another hole (also not shown) in which a pivot shaft 30 is rotatably fitted as shown in FIG. 4, the pivot shaft 30 pivotally supporting and being fixed to a lock lever 31 at its middle part. This lock lever 31 at its one end has a riser part 32, from which an engagement projection 33 projects outward. A yoke part 34 is formed on the other end of the lock lever 31, which functions as a shifting member.

The yoke part 34 is engaged with a pin 40 fixed to one end of a link 36 and projecting upward (as viewed in FIG. 4) therefrom. This one end of the link 36 is slidably guided within and by a guide 39 integrally formed with the base member 2. The other end 37 of the link 36 has at its lower part an actuating pin (not shown) projecting downward and engaged with the aforementioned slot 15 of the ratchet lever 11. The other end 37 of the link 36 has at its upper part a contact lug 38.

Accordingly, when a turning force is applied to the engagement projection 33 of the lock lever 31 to cause the lock lever to rotate about the pivot shaft 30, this movement is transmitted by way of the engagement parts of the yoke part 34 and the pin 40 to cause displacement of the link 36 in substantially its longitudinal direction, and the actuating pin (not shown) of the end 37 of the link 36 is guided by the slot 15 at one end of the ratchet lever 11 and undergoes a displacement within the confines of the slot 15.

Figure 2:
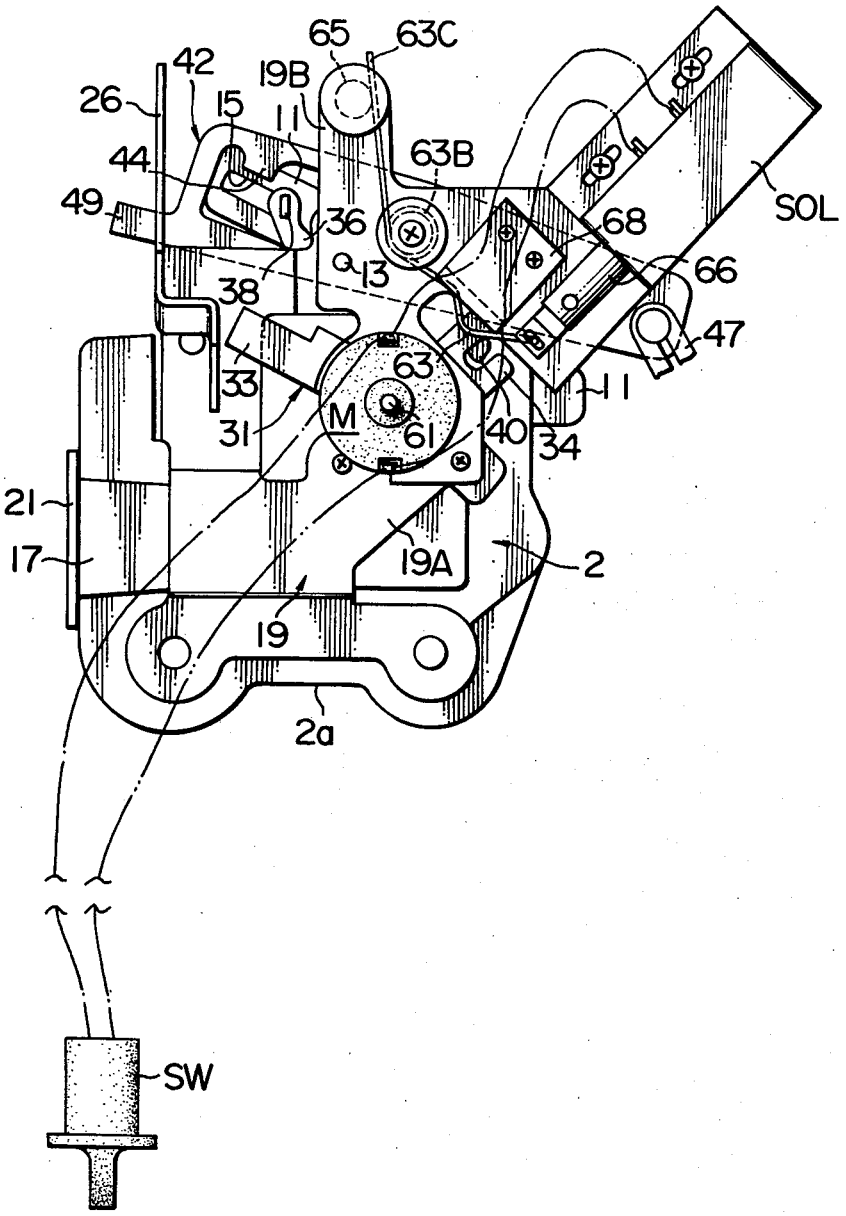
FIG. 2 is a plan view of the same latch device.
Figure 5:
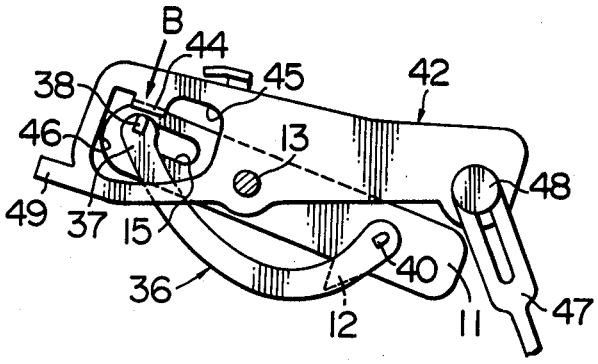
FIG. 5 is a plan view showing an open lever, a coupling link, a ratchet lever, and an actuating link, the coupling link being shown in an unlock state wherein it is enabling the device to be unlocked by either an outside or inside door handle.

As shown in FIGS. 2 and 5, a release lever 42 is rotatably supported at an intermediate point thereof on the aforementioned pivot pin 13 on the underside (as viewed in FIG. 2) of the frame structure 19. This release lever 42 lies between and parallel to the ratchet lever 11 and the frame structure 19 and is continually urged to rotate clockwise, as viewed in FIG. 1, about the pivot pin 13 by the elastic force of a spring (not shown) wound around the pivot pin 13.

As shown in FIG. 5, the release lever 42 is provided at one end part thereof with an opening 46 having an inwardly projecting part 44 for contacting the above mentioned contact lug 38 of the link 36 and a recessed part 45 adjacent to the projecting part 44. Furthermore, one end of an actuating link 47 is pin-connected by a pin 48 to the other end of the release lever 42. The other end of the actuating link 47 is connected to the outside door handle of the door in the case of installation in a door of a motor vehicle. In addition, at the end of the release lever 42 provided with the opening 46, a projection 49 is formed to project outward, away from the pivot pin 13. This projection 49 is engageable by a rotating lever (not shown) known in the art, which is actuated by an inside door handle of the vehicle. This rotating lever is appropriately pivoted in the known manner on the vertical wall 26 of the frame structure 19.

When the latch device is in its normal or unlocked state, the link 36 is in the position indicated in FIG. 5, in which its contact lug 38 is confronting the projecting part 44 of the open lever 42. When, with these parts in this state, the release lever 42 is caused to rotate in the counterclockwise direction as viewed in FIG. 5 by manipulative turning of the outside or inside door handle, the projecting part 44 of the release lever 42 presses the contact lug 38 in the arrow direction B. As a consequence, the aforementioned actuating pin projecting downward from the end 37 of the link 36 below the contact lug 38 acts on the edge of the slot 15 of the ratchet lever 11 to turn the ratchet lever in the same direction, that is, in the direction A in FIG. 3, whereby the latch L is released and becomes free, thereby placing the striker S in a state wherein it can escape, in relative movement, out of the latch device body.

Figure 6:
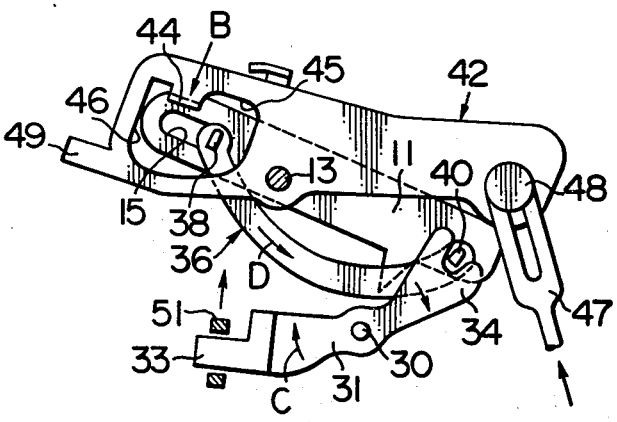
FIG. 6 is a plan view similar to FIG. 5 with the addition of a lock lever, the coupling link being shown in a lock state wherein the device cannot be unlocked by either door handle.

In order to place the latch device in its locked state, the lock lever 31 is turned in the arrow direction C in FIG. 6. This action can be accomplished by causing a fork member 51 coupled to an actuating device for locking to act on and move the engagement projection 33 at one end of the lock lever 31 in the arrow direction. Consequently, the link 36 is drawn in the arrow direction D by the yoke part 34 of the lock lever 31 acting on the pin 40 of the link 36, and the downwardly projecting pin below the contact lug 38 at the other end 37 of the link 36 is displaced along the slot 15 of the ratchet lever 11 and assumes the position indicated in FIG. 6.

When, with the mechanism in this state, the release lever 42 is turned in the counter clockwise direction to cause displacement of its projecting part 44 in the arrow direction B, the contact lug 38 cannot be pushed. Moreover, because of the provision of the recessed part 45 in the periphery of the opening 46 of the open lever 42, the open lever 42 cannot act on the contact lug 38. For this reason, the ratchet lever 11 is inoperative, and the latch device cannot be unlatched or unlocked.

To unlock the device from its locked state, the lock lever 31 is turned in the opposite direction thereby to return the link 36 again to the state indicated in FIG. 5.

Thus, the lock lever 31 is used to place the latch device in the locked state and in the unlocked state in the above described manner. In some vehicles, this actuation of the lock lever 31 is carried out by motive power means such as a solenoid or a motor energized by the driver. In any case, it is necessary that the pin at the end of the link 36 below the contact lug 38 be caused to assume within the slot 15 the lock position and the unlock position at the two extremities of the slot 15 and be prevented from assuming an intermediate position between the two end positions.

Accordingly, in a known latch device, the lock lever 31 for causing displacement of the link 36 is adapted to undergo angular displacement with a click motion between the end positions of its swinging movement, so that it cannot assume an intermediate position. For this purpose, an over-center spring (or dead-center spring) of relatively great spring force is provided to act on the lock lever 31, whereby, when the lock lever 31 passes the center point of its swinging movement, that is, its dead-center point, it is caused by the elastic force of the over-center spring to swing abruptly with a snap motion toward either of its terminal positions and is firmly retained in that terminal position.

For this reason, when the lock lever 31 is shifted from one terminal position to the other terminal position in this known latch device, a considerably great force is required to cause angular displacement of the lock lever 31 up to the position where it is about to pass over the dead-center point. Consequently, in the case where the lock lever 31 is actuated by motive power means such as a solenoid or a motor, a relatively great current is required to operate the motive power means as mentioned hereinbefore. Since a door-latch device is provided for each door, the required current is proportional to the number of doors.

This invention provides a novel latch device which, in the case where its lock lever is actuated by driving power, requires considerably less power than in the prior art case.

Referring to FIGS. 1 and 2, the lock lever 31 is driven in its rotation between its lock and unlock positions by a rotational driving power means M, which comprises, for example, an electric motor or a rotary-type solenoid. The aforedescribed frame structure 19 has, in addition to its part 19A described hereinbefore, an extension part 19B extending (upward as viewed in FIG. 2) beyond the release lever 42. As shown in FIG. 1, these parts 19A and 19B of the frame structure 19 at the middle part thereof are mutually overlapping and are fixed to the surface of the base member 2.

The driving power means M has a rotary output shaft 61 which is perpendicular to the frame structure 19 and, extending downward as viewed in FIG. 1, is coupled directly with the pivot shaft 30 of the lock lever 31. Accordingly, the lock lever 31 can be rotated in either desired direction by causing the motive power means M to rotate in the corresponding direction. The driving power means M is mounted at its mounting part 60 on the frame structure 19 by suitable means.

As mentioned hereinabove, in order to impart a click motion or snap motion to the lock lever 31 thereby to prevent it from assuming an intermediate position, an over-center spring 63, as briefly mentioned hereinabove, is provided as a holding member. As shown best in FIG. 7, this over-center spring 63 comprises a length of wire of an elastic material such as a piano wire having a bent part 63A with a crest near one end 63D thereof and a coiled middle part 63B fitted around a pin 64 fixed to and projecting from the frame structure part 19A. The other end 63C of the spring 63 is engaged with a pin 65 similarly fixed to and projecting from the frame structure part 19A. The first-mentioned end 63D of the spring 63 is engaged with an end of a plunger 66 of a solenoid SOL.

Figure 7:
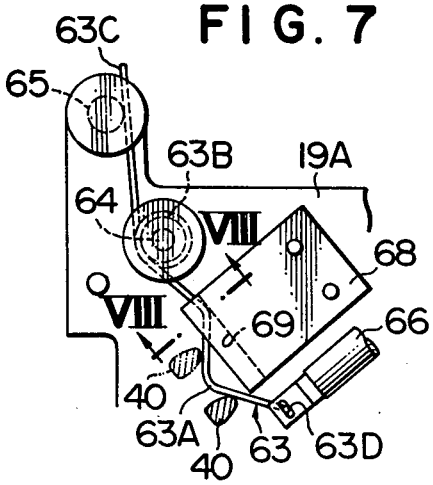
FIG. 7 is a fragmentary plan view showing an over-center spring device and a part of means for temporarily nullifying the action of a retaining member.
Figure 8:
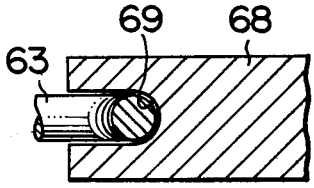
FIG. 8 is an enlarged, fragmentary view in section taken along the plane indicated by line VIII—VIII in FIG. 7 as viewed in the arrow direction.

The spring action of the spring 63, most of which is derived from the coiled part 63B, results in an elastic force urging the bent part 63A to be displaced obliquely toward the left and downward as viewed in FIG. 7. This displacement of the bent part 63A is arrested by its contact against the aforedescribed pin 40 fixed to one end of the link 36 and engaged by the yoke part 34 of the lock lever 31. As shown in FIGS. 7 and 8, a part of the spring 63 in the vicinity of the bent part 63A thereof is guided by and in a groove 69 in a guide member 68 fixedly mounted on the frame structure part 19A.

In order to cause the lock lever 31 to rotate about its shaft 30, the link 36 (FIGS. 5 and 6) must be caused to undergo displacement in substantially its longitudinal direction. For realizing this movement, the pin 40 of the link 36 must over-ride over the crest of the bent part 63A of the spring 63 between the positions of the pin 40 respectively indicated by solid line and by intermittent line. This over-riding action results in the aforementioned click motion applied to the lock lever 31. However, as mentioned hereinbefore, a considerably great force is required to cause the pin 40 to undergo the over-riding displacement against the counter-acting spring force acting on the bent part 63A. For this reason, the driving power means M tends to become one of large size and high output.

This invention solves this problem in the manner briefly summarized below and described more fully hereinafter. The function of the over-center spring 63 is restricted to its action of holding the pin 40 at its two terminal positions, and, at the instant when the pin 40 over-rides the spring 63, the bent part 63A thereof is retracted so that no resistance is imparted to the displacement movement of the pin 40. As a result, only a very small force imparted by the driving power means M by way of the lock lever 31 to the pin 40 suffices for positive operation, whereby a driving power means M of small size and low output can be used.

Figure 9A:
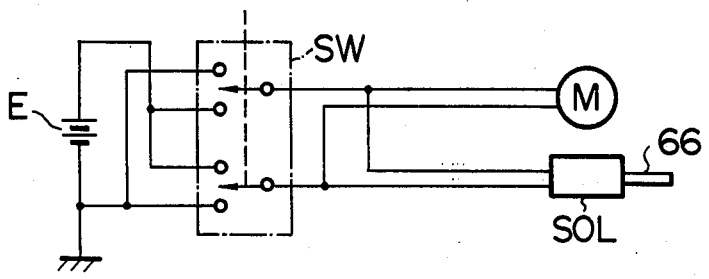
FIGS. 9A and 9B are electrical circuit diagrams respectively showing control circuits suitable for use to drive the latch device of the invention.

The above summarized operation can be achieved by this invention by the use of an electrical circuit, one example of which is shown in FIG. 9A. As shown, a driving power means such as, for example, a motor M for forward-reverse operation is connected in parallel with a solenoid SOL to a direct-current electric power source E through a control switch SW. This switch SW comprises two ganged switches, for example. When this switch SW is switched to upper contact points, as viewed in FIG. 9A, the solenoid SOL is energized, and its plunger 66 is retracted. At the same time, the motor M rotates in one direction (e.g., the forward direction). When the switch SW is switched to the lower contact points, the solenoid SOL is similarly retracted, and at the same time the motor rotates in the opposite (i.e., the reverse) direction.

By the use of a circuit of this simple character, the single action of switching the switch SW to either of its two positions causes the motor M to rotate in the corresponding one of two directions and, simultaneously, the plunger 66 of the solenoid SOL to retract and pull the bent part 63A of the spring 63 toward the interior of the groove 69 of the guide member 68, whereby the pin 40, in moving to the corresponding one of the two terminal positions, does not meet the resisting force which it would otherwise be required to overcome in elastically deflecting the bent part 63A and therefore can be thus moved to the corresponding terminal position by only a small force. This means that a small motor M of low output torque is sufficient.

When, upon completion of the shifting of the pin 40 by the motor M, the switch SW is turned off, that is, placed in the state indicated in FIG. 9A, the solenoid SOL becomes deenergized, and its plunger 66 is returned to its advanced position by the force of the spring 63, which is therefore restored to its original state, whereby its bent part 63A retains the pin 40 in its terminal position to which it has been shifted.

Figure 9B:
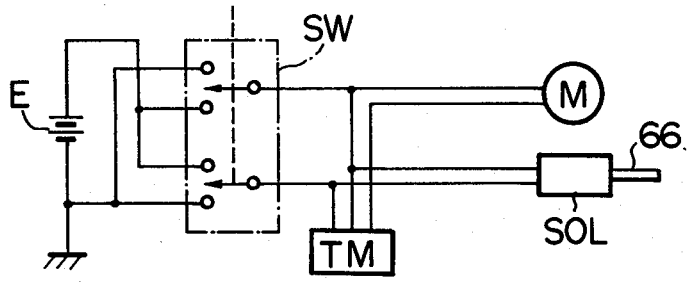

While, in the above described example, the motor M and the solenoid SOL are simultaneously energized, the circuit may be so modified that electric power is supplied to the motor M with a specific time lag after the bent part 63A of the spring 63 has been fully retracted by the solenoid SOL, which is energized first. For this modification, a timer TM can be inserted in the circuit, for example, as shown in FIG. 9B.

Figure 10:
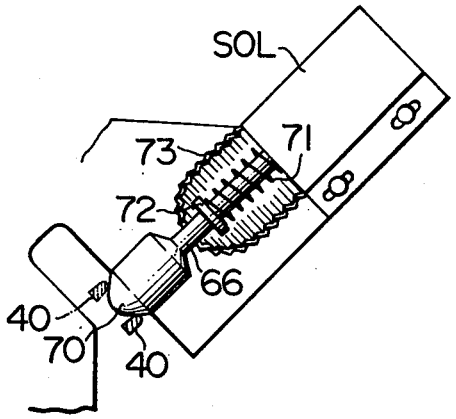
FIG. 10 is a fragmentary plan view showing another example of the mechanism illustrated in FIG. 7.

In another embodiment of this invention as shown in FIG. 10, the means for retaining the pin 40 in either the lock position or the unlock position comprises a wedge-like retaining member 70 provided at the outer extremity of the plunger 66 of a solenoid SOL and a compression spring 71 for imparting an elastic force to the retaining member 70 urging it toward the path of movement of the pin 40. The spring 71 is disposed in elastically compressed state around the plunger 66 and exerts its spring force on the casing of the solenoid SOL and a spring-seat flange 72 fixed to the plunger 66. The spring 71, the flange 72, and the part of the plunger 66 in the vicinity thereof are covered by a flexible waterproof cover 73 which can be freely contracted and stretched.

The pin 40 is retained in either of the lock and unlock positions by one of the inclined surfaces of the retaining member 70 imparting an elastic retaining force thereto under the force of the spring 71. At the time when the pin 40 is to be shifted, the solenoid SOL retracts the plunger 66 against the force of the spring 71, thereby also retracting the retaining member 70. As a result, the pin 40 can shift to the other terminal position without meeting resistance due to the retaining member 70 and the spring 71.

In still another embodiment of this invention as illustrated in FIGS. 11 through 14, the above described positive placement of the lock mechanism in either the lock position or the unlock position is not accomplished by a crested member acting with a click motion directly on the pin 40 of the ink 36. Instead, a mechanism for producing the over-center or click action is provided to act on a sector gear 76 driven in forward and reverse directions by a motor Ma and, in turn, driving the lock lever **31*a***, as described below.

Figure 11:
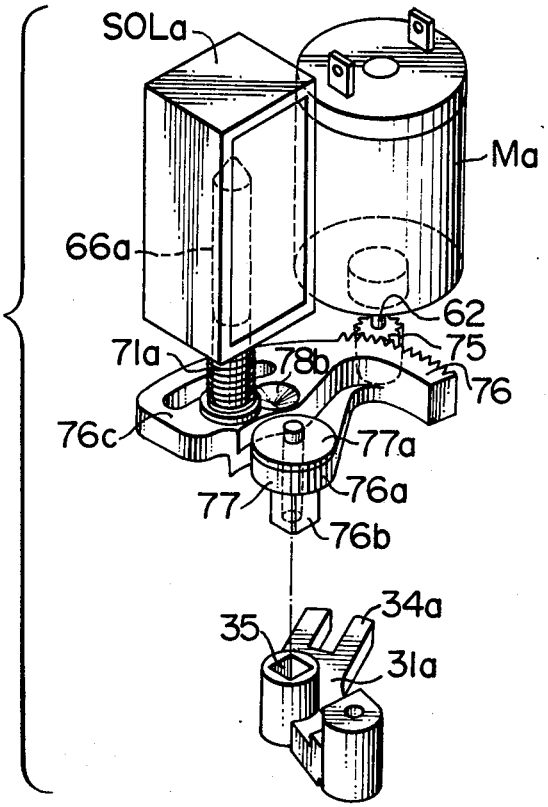
FIG. 11 is a partly exploded perspective view showing a third example of a over-center click-motion device and its relation to a lock lever.
Figure 12:
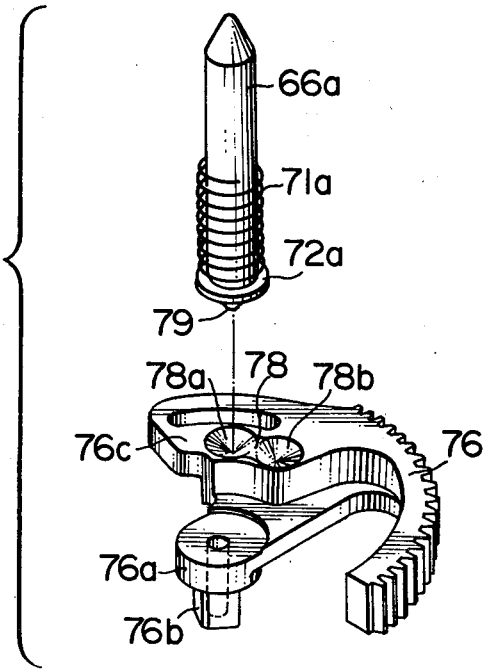
FIG. 12 is an exploded perspective view of essential parts of the device shown in FIG. 11.

As shown in FIG. 11, the output shaft 62 of the motor Ma is provided with a pinion 75 fixed thereto and meshed with a sector gear 76. The sector gear 76 is provided with a hub part **76*a* around its center of rotation and a part 76*c* between the sector gear teeth and the hub part 76*a*. An output shaft part 76*b* of square cross section with a central bore is coaxially and integrally formed with the hub part 76*a* to extend therefrom and is fitted in a square bore 35 formed in the lock lever 31*a* at the pivotal point thereof coinciding with that of the pivot shaft 30 in the preceding examples. The sector gear 76 pivots about a pivot pin 77 fitted in the central bore of the square shaft part 76*b* and an extension of the central bore through the hub part 76*a*. The pivot pin 77 has a flange 77*a* and is supported by a casing 80** described hereinafter.

The above mentioned part **76*c* of the sector gear 76 is provided on a flank surface thereof with a pair of conical depressions 78*a* and 78*b*, the centers of which are spaced apart, but which are mutually overlapped or merged slightly at contiguous peripheral parts thereof to form a saddle-like "hump" or ridge 78 therebetween. The centers of the conical depressions 78***a* and 78*b* and the ridge 78 lie on an arc of a circle whose center coincides with the axis of rotation of the sector gear 76.

A conical retaining head 79 formed at the outer extremity of a plunger 66*a* of a solenoid SOLa is adapted to be pressed by elastic force against the part 76*c* so as to fit into either of the conical depressions 78*a* and 78*b* as described below.

The plunger 66*a* is provided on the inner side of the retaining head 79 with a spring-seat flange 72*a* fixed thereto. A compression spring 71*a* is disposed in compressed state around the plunger 66*a* and between the spring-seat flange 72*a* and the body of the solenoid SOLa and continually exerts an axial force on the plunger 66*a* urging it to move outward toward the part 76*c* of the sector gear 76.

Thus, when the solenoid SOLa is in its deenergized state, the retaining head 79 is pressed by the force of the spring 71*a* against and in either one of the depressions 78*a* and 78*b*, thereby retaining the sector gear 76 at that angular position where the center of that depression coincides with the center of the retaining head 79. The sector gear 76 can be rotated by the motor Ma to the angular position where the center of the other depression coincides with center of the retaining head 79. During this rotation of the sector gear 76, the retaining head 79 is forced to overcome the force of the spring 71*a* to over-ride the "hump" or ridge 78 interposed between the two depressions 78*a* and 78*b* and functioning as a dead-center member. Thus a click motion is obtained, and the sector gear 76 can thereby be retained firmly in either of two angular positions and prevented from stalling or lingering in an intermediate position.

Figure 13:
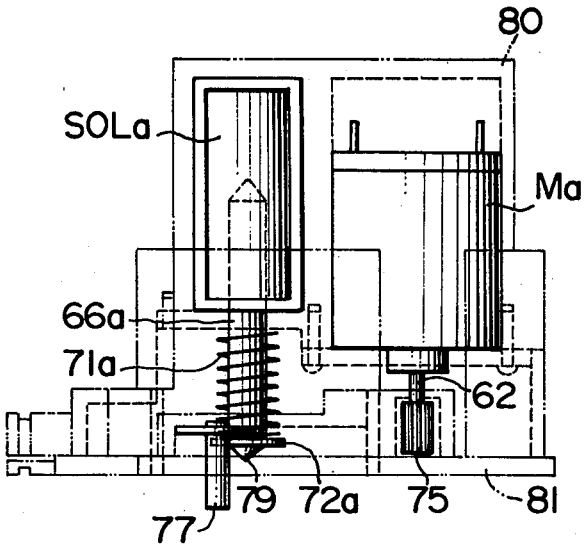
FIG. 13 is a side view of the same device housed in a casing covered by a casing cover.
Figure 14:
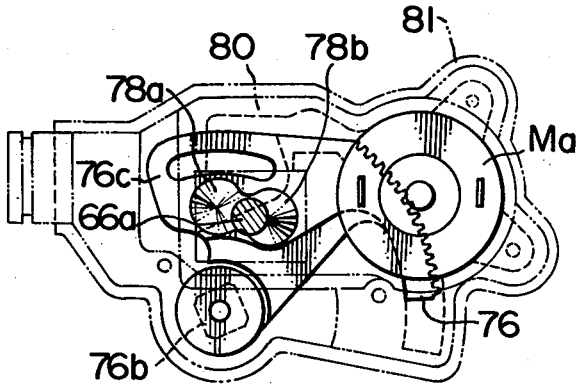
FIG. 14 is a plan view, orthogonal to FIG. 13, showing the housed device.

The above described mechanism, including the motor Ma and the solenoid SOLa but not the lock lever 31*a*, is preferably housed in and supported by a casing 80 and a casing cover 81 as indicated by chain lines in FIGS. 13 and 14. The motor Ma and the solenoid SOLa are connected in a control circuit as shown in FIGS. 9A or 9B.

The mechanism of the above described organization is controlled and operates in the following manner.

To lock or unlock the latch device, the switch SW is switched to the corresponding side as in the preceding examples, whereupon the motor Ma drives the sector gear 76 in the corresponding direction. Simultaneously, or a short time previously, the solenoid SOLa is energized and retracts its plunger 66*a*, thereby separating the retaining head 79 from the sector gear 76 and reducing the torque required of the motor Ma to rotate the sector gear 76. After the sector gear 76 has been rotated to its other terminal position where the center of the retaining head 76 coincides with that of the other depression (78*a* or 78*b*), the switch SW is turned off, whereupon the solenoid SOLa is deenergized, and the retaining head fits firmly in that other depression, thereby retaining the sector gear in its new terminal position.

Since the lock lever 31*a* is positively coupled to the sector gear 76 by the insertion of the output shaft part 76*b* of square cross section of the sector gear 76 in the square bore 35 in the lock lever 31, the lock lever 31 is also positively driven in rotation with a click motion between two distinct terminal positions for locking and unlocking and prevented from stalling in an intermediate position. Thus, the lock lever 31 can actuate the link 36 in a similar manner between two terminal positions as in the preceding examples.

According to this invention, as described above with respect to embodiments thereof, there is provided a mechanism having a spring means for retaining, in either of a lock position or an unlock position, a shifting member which undergoes displacement between the two positions and for producing a click motion between the two positions, and means are provided for temporarily nullifying the action of the spring so as to remove or reduce resistance to that displacement and to reduce the power required by a driving means for driving the shifting member.

What is claimed is:

1. A latch device comprising: a latch mechanism which can be actuated to hold a striker in latched state and to release the same in unlatched state; a locking mechanism which can be actuated between lock and unlock positions respectively to hold the latch mechanism in said latched state and to place the same in said unlatched state, said locking mechanism including a shifting member movable between a terminal lock position and a terminal unlock position thereby to actuate the locking mechanism between the lock and unlock positions thereof; a driving power source for driving the shifting member between said terminal positions; a retaining mechanism for exerting an elastic force such as to cause the shifting member to undergo displacement between said terminal positions with a click motion over an intermediate dead-center point by overcoming an elastic resistance due to said elastic force up to the dead-center point and to retain the shifting member positively in either of the terminal lock and unlock positions after each displacement; and retraction means for temporarily nullifying or greatly reducing said action of the retaining mechanism at the time of said displacement of the shifting member.

2. The latch device as claimed in claim 1 in which the retaining mechanism comprises a spring having a bent part with a crest constituting a retaining member and engaging said shifting member, said bent part normally projecting under spring force in the path of displacement of the shifting member to contact and thus retain the shifting member in either terminal position thereof and to provide said click motion wherein said crest functions as said dead-center point, and said retraction device operates to retract the bent part out of said path against the force of the spring.

3. The latch device as claimed in claim 1 in which the retaining mechanism comprises a retaining member having a wedge-like part with a crest engageable with the shifting member, said wedge-like part normally being urged by a spring to project into the path of the displacement of the shifting member to contact and thus retain the shifting member in either terminal position thereof and to provide said click motion wherein said crest functions as said dead-center point, and said retraction device operates to retract the wedge-like part out of the said path against the force of the spring.

4. The latch device as claimed in claim 1 in which the retaining mechanism comprises: a pair of conical depressions formed in a surface of the shifting member at spaced-apart but partly overlapping positions lying along a single path of movement of the shifting member, a hump or ridge being formed at the overlapping part of the depressions and functioning as said dead-center point; a retaining head of convex conical shape adapted to fit snugly in either of the depressions determining terminal lock and unlock positions of the shifting member, the retaining head undergoing said displacement with said click motion relative to the depressions; and a spring continually urging the retaining head to move toward the shifting member and into said path, the retracting device operating to retract the retaining head away from the depressions against the force of the spring.

5. The latch device as claimed in claim 2 or 3 in which the shifting member is a pin fixed to a member of the locking mechanism.

6. The latch device as claimed in claim 4 in which the shifting member is a sector gear driven by a pinion, which is driven in turn by the driving power source.

7. The latch device as claimed in any of the preceding claims in which the retraction means is electromagnetic driving means.

* * * * *

UNITED STATES PATENT AND TRADEMARK OFFICE

CERTIFICATE OF CORRECTION

PATENT NO. : 4,455,042

DATED : June 19, 1984

INVENTOR(S) : SHINJIRO YAMADA

It is certified that error appears in the above-identified patent and that said Letters Patent is hereby corrected as shown below:

IN THE HEADNOTE:

Between item [22] and item [51], insert

--[30] Foreign Application Priority Data

May 29, 1981 Japan.....56-80875--

Signed and Sealed this

Second Day of October 1984

[SEAL]

*Attest:*

GERALD J. MOSSINGHOFF

*Attesting Officer*

*Commissioner of Patents and Trademarks*